United States Patent [19]

Robinson

[11] Patent Number: 4,620,334

[45] Date of Patent: Nov. 4, 1986

[54] INFANT ROCKER

[76] Inventor: Alec Robinson, 465 Victoria Street, West Melbourne, Victoria, Australia, 3003

[21] Appl. No.: 408,245

[22] Filed: Aug. 16, 1982

[51] Int. Cl.[4] ..... A47D 9/02

[52] U.S. Cl. ..... 5/108; 5/109; 128/33

[58] Field of Search ..... 5/108, 109, 93 R, 107, 5/400; 128/33

[56] References Cited

U.S. PATENT DOCUMENTS

| | | | |
|---|---|---|---|
| 1,842,290 | 1/1932 | Salamon | 5/109 |
| 2,668,530 | 2/1954 | Tackaberry | 5/109 |
| 2,765,478 | 10/1956 | Pinto | 5/109 |
| 3,022,520 | 2/1962 | Finger . | |
| 3,056,145 | 10/1962 | McKinley et al. | 5/109 |
| 3,186,008 | 6/1965 | Fuller | 5/109 |
| 3,322,117 | 5/1967 | McCaw | 128/33 |
| 3,439,363 | 4/1969 | Meeks . | |
| 3,724,008 | 4/1973 | Golden | 5/400 |
| 3,732,585 | 5/1973 | Krehbiel | 5/400 |
| 3,762,402 | 10/1973 | Abramovitz | 128/33 |
| 3,874,011 | 4/1975 | Walsh et al. | 5/108 |
| 3,967,333 | 7/1976 | Boyd | 5/424 |

FOREIGN PATENT DOCUMENTS

| | | | |
|---|---|---|---|
| 221676 | 10/1957 | Australia . | |
| 662474 | 5/1963 | Canada | 5/108 |
| 1126176 | 11/1956 | France | 5/109 |
| 1138539 | 6/1957 | France | 5/109 |

*Primary Examiner*—Gary L. Smith
*Assistant Examiner*—Michael F. Trettel
*Attorney, Agent, or Firm*—Robert J. Koch

[57] ABSTRACT

An infant rocker arranged to support a bassinet or the like on a support tray suspended bu coil springs above a base and drive means arranged to rhythmically move the support tray and hence the bassinet in a predetermined pattern, which is preferably an orbital motion, in a plane parallel to the base.

13 Claims, 3 Drawing Figures

INFANT ROCKER

This invention relates to an infant rocker and has been devised particularly though not solely as a support for a device such as a bassinet.

It is desirable to provide a device which will enable an infant's cradle or bassinet or similar device to be supported and moved rhythmically in a rocking motion or similar to pacify the infant. Various bassinets or cradles have been provided in the past which will enable the infant to be rocked by hand but this has always required the presence of a person such as the mother to rock the infant and which does not permit the mother to do other jobs while rocking the infant and keeping the infant placated. Other mechanised devices have been devised which rock or oscillate the infant in various manners but which are often complicated and therefore expensive to manufacture and are not always effective in pacifying the infant.

It is therefore an object of the present invention to provide an infant rocker which will obviate or minimize the foregoing disadvantages in a simple yet effective manner or which will at least provide the public with a useful choice.

Accordingly the invention consists in an infant rocker comprising a base, infant support means mounted on the base by suspension means allowing a predetermined degree of movement between the base and the support means substantially in a plane parallel to the base, and drive means arranged to rhythmically move the support means relative to the base in a predetermined pattern in said plane.

Notwithstanding any other forms that may fall within its scope one preferred form of the invention will now be described by way of example only with reference to the accompanying drawings in which.

Figures 1, 2, 3:
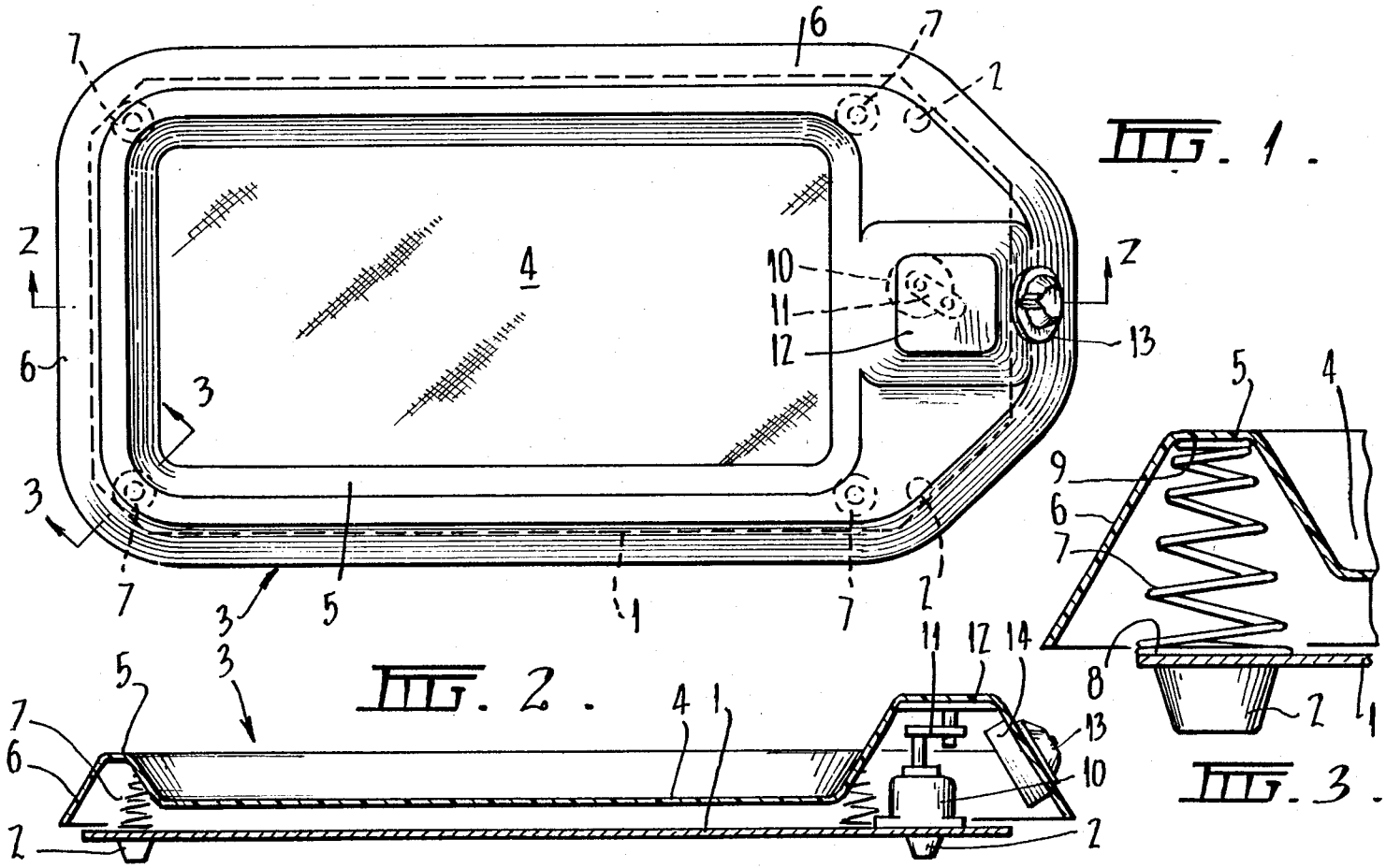
FIG. 1 is a plan view of an infant rocker according to the invention.
FIG. 2 is a cross-sectional elevation on the line 2—2 of FIG. 1.
FIG. 3 is a cross-sectional elevation to an enlarged scale on the line 3—3 of FIG. 1, showing the suspension between the base and the support means of the infant rocker.

In the preferred form of the invention an infant rocker particularly suitable for supporting a bassinet or the like is constructed as follows although it will be appreciated that the invention may also be applied in different forms to the support of other infant apparatus such as cots.

In the preferred form of the invention the infant rocker is provided with a base 1 having feet 2 which may be for example rubber mounting pads which enable the base to be placed on and supported by a flat surface such as a floor or table top.

The rocker is provided with infant support means in the form of a tray 3 which may for example be moulded in one piece from plastics material and which has a central recessed portion 4 surrounded by an upstanding lip 5 forming a support surface and edge restraint for a bassinet. The tray is sized so that a typical bassinet may be placed in the recessed tray portion 4 and held in place by the raised lip or flange 5 surrounding the tray portion. The flange 5 is provided with a downwardly depending skirt 6 coming close to the support surface level so as to enclose the base of the infant rocker.

The infant support means 3 is mounted on the base by suspension means which may for example be in the form of conical springs 7 extending upwardly from the base at point 8 (FIG. 3) to the underside of the tray at a convenient point for example at point 9 on the underside of the lip 5. Either end of the spring may be fastened to the base and to the underside of the tray respectively (for example, by way of clips) and there may be as many springs provided as are necessary to evenly support the weight of the infant support means and of a bassinet containing an infant placed in the tray 4. For example four such conical springs may be provided located at each corner of the tray 4. The conical springs form suspension means for the infant support means which allow the support means to move substantially in a plane parallel to the base for example in a back and forth or side to side reciprocating motion or in an orbital motion.

The infant rocker is further provided with drive means in the form of an electric motor 10 which is conveniently mounted on the base 1 and has an upwardly protruding drive shaft which is connected to a drive mechanism 11. The drive mechanism may take any desired form such as a crank or cam type drive to impart the desired motion to the infant support means 3 when driven by the motor 10. For example the drive mechanism may comprise a yoke type drive to transmit a reciprocating motion to the infant support means or a cam drive having a follower on the infant support means to once again impart a reciprocating motion to the infant support means 3. In the preferred form of the invention however, the drive means comprises an eccentric crank which may for example, be a crank arm as shown in the drawings or which may be any other type of eccentric drive such as a disc having an offset drive shaft from the motor 11 which is rotated within a bearing held in the upper portion 12 of the infant support means above the motor 10. A drive of this nature will impart an orbital motion from the drive shaft of the motor 10 to the infant support means causing the infant support means to move in an orbital fashion in a plane substantially parallel to the base 1.

The motor may be a geared motor having a low speed output such as a worm and wheel geared drive having an output speed of approximately 10 rpm.

In use the infant rocker is placed upon a suitable support surface such as on the floor or on a table and the electric motor 10 is provided with a supply of electric current from a convenient power point. The infant in its bassinet is placed on the tray 4 and the motor is actuated to drive the support means in the predetermined motion such as in the orbital motion which rocks the baby within the bassinet providing a soothing motion to pacify the infant.

The device may also be provided with a timer 14 wired to the motor and controlled by a calibrated knob 13 so that the rocker may be set in motion for a predetermined period of time and then left without requiring further attention. This feature is particularly useful at night-time.

In this manner an infant rocker is provided which enables a baby to be rocked and pacified without attention from the mother who is therefore freed to perform other tasks.

I claim:

1. An infant rocker comprising:

a base;

support means for supporting an infant;

suspension means for mounting said support means on said base and allowing a predetermined degree of movement between the base and the support means substantially in a plane parallel to the base; and drive means for gently and rhythmically moving the support means relative to the base in an orbital motion pattern in said plane to lull an infant.

2. An infant rocker as claimed in claim 1, wherein said drive means comprises a crank type drive mechanism.

3. An infant rocker as claimed in claim 1, wherein said drive means comprises an electric motor.

4. An infant rocker as claimed in claim 1, wherein said drive means comprises a low speed electric motor.

5. An infant rocker as claimed in claim 1, wherein said suspension means comprises springs extending between said base and said infant support means.

6. An infant rocker as claimed in claim 5, wherein said springs comprise conical springs.

7. An infant rocker as claimed in claim 1, wherein said infant support means comprises a flat support surface adapted to receive and support an infant container such as a bassinet.

8. An infant rocker as claimed in claim 7, wherein said infant support means comprises a one piece molded plastic element having a central flat tray area and a peripheral flange, wherein said flat support surface comprises said central flat tray area which is adapted to receive and support a bassinet or the like, and wherein said peripheral flange is provided extending upwardly from the bassinet support surface and then outwardly and downwardly in a skirt portion around the periphery of the infant rocker.

9. An infant rocker as set forth in claim 1 and further including timer means connected to said drive means for actuating said drive means for a predetermined time period.

10. An infant rocker comprising:

a base;

support means for supporting an infant, suspension means for mounting said support means on said base such that said support means is free to move in a plane parallel to said base;

a motor connected to said base, said motor having a drive shaft with a vertical axis of rotation; and linkage means connecting said motor shaft to said support means such that rotation of said motor shaft produces a low speed orbital motion pattern of said support means in said plane to lull an infant.

11. An infant rocker as set forth in claim 10 and further including a timer connected to said motor for actuating said motor for a predetermined time.

12. An infant rocker comprising:

a base;

support means for supporting an infant;

suspension means for mounting said support means on said base and allowing a predetermined degree of movement between the base and the support means substantially in a plane parallel to the base; and drive means for gently moving the support means relative to the base in a rhythmical orbital low speed motion pattern in said plane.

13. An infant rocker as in claim 12 wherein said drive means imparts said orbital motion to said support means at a location displaced from a geometric center of said support means.

* * * * *